US007572388B2

(12) United States Patent
Terashima et al.

(10) Patent No.: US 7,572,388 B2
(45) Date of Patent: Aug. 11, 2009

(54) MAGNET COMPOUND MATERIAL TO BE COMPRESSION MOLDED, A MOLDED ELONGATE MAGNETIC, A MAGNET ROLLER, A DEVELOPING AGENT-CARRYING BODY, A DEVELOPING APPARATUS AND AN IMAGE-FORMING APPARATUS

(75) Inventors: Satoshi Terashima, Zama (JP); Sumio Kamoi, Tokyo (JP); Yoshiyuki Takano, Hachiouji (JP); Tsuyoshi Imamura, Sagamihara (JP); Kyohta Koetsuka, Fujisawa (JP); Noriyuki Kamiya, Yamato (JP); Mieko Terashima, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 11/497,385

(22) Filed: Aug. 2, 2006

(65) Prior Publication Data

US 2007/0036590 A1 Feb. 15, 2007

(30) Foreign Application Priority Data

Aug. 2, 2005 (JP) ..... 2005-224558

(51) Int. Cl.
*H01F 7/02* (2006.01)

(52) U.S. Cl. ..... 252/62.54; 252/62.55

(58) Field of Classification Search ..... 252/62.54
See application file for complete search history.

(56) References Cited

U.S. PATENT DOCUMENTS

| | | | |
|---|---|---|---|
| 6,385,423 | B1 | 5/2002 | Kai |
| 2004/0094742 | A1 | 5/2004 | Kawano et al. |

FOREIGN PATENT DOCUMENTS

| | | |
|---|---|---|
| JP | 05-308009 | 11/1993 |
| JP | 08-031677 | 2/1996 |
| JP | 10-004023 | 1/1998 |
| JP | 10-135017 | 5/1998 |
| JP | 2001-240740 | 2/2000 |
| JP | 2001-093724 | 4/2001 |
| JP | 2001-118718 | 4/2001 |
| JP | 2002-190421 | 7/2002 |
| JP | 2006-070075 | 3/2006 |

OTHER PUBLICATIONS

European Search Report dated Oct. 17, 2006, for corresponding European Patent Application No. 06015977.

*Primary Examiner*—C. Melissa Koslow
(74) *Attorney, Agent, or Firm*—Harness, Dickey & Pierce, P.L.C.

(57) ABSTRACT

A magnet compound material to be compression molded, said magnet compound material comprising a magnetic powder and a binder resin particles, wherein a ratio of Dv to Dn is in a range of 1.1 to 1.3, Dv and Dn of the binder resin particles denote the volume average particle diameter and the number average particle diameter, respectively.

9 Claims, 7 Drawing Sheets

MAGNET COMPOUND MATERIAL TO BE COMPRESSION MOLDED, A MOLDED ELONGATE MAGNETIC, A MAGNET ROLLER, A DEVELOPING AGENT-CARRYING BODY, A DEVELOPING APPARATUS AND AN IMAGE-FORMING APPARATUS

BACKGROUND OF THE INVENTION (1) Field of the Invention

The present invention relates to a magnet compound material to be compression molded, which is used for producing molded elongate magnet to be buried in magnet rollers employed in image-forming apparatuses such as copiers, facsimile apparatuses and printers. The invention also relates to such molded elongate magnet produced from the magnet compound material, magnet rollers in which such molded elongate magnet are buried, developing agent-carrying bodies having such magnet rollers, a developing apparatus having such a developing agent-carrying body, a processing cartridge having such a developing apparatus, and an image-forming apparatus having such a processing cartridge. The term "elongate" means that a longitudinal length of the elongate magnet is considerably larger than a longitudinal length of a sectional view of the magnet as cut in a direction orthogonal to the longitudinal direction of the elongate magnet.

(2) Related Art Statement

"A high-performance developing apparatus, which develops latent images formed on an image-carrying body with use of a two-component developing agent composed of a toner and an magnetic grains" (hereinafter referred to "SLIC developing apparatus" (SLIC: Sharp Line Contact), have recently attracted public attention, and solved problems in images. A developing agent-carrying body (developing roller) to be mounted on this SLIC developing apparatus is required to meet the following characteristics: (1) a half-value width of a developing pole is not more than 20° (about 50° in the conventional two-component development) and (2) the magnetic flux density is in a range of 100 to 130 mT (80 to 120 mT in the conventional two-component development). In the SLIC developing apparatus, it is necessary that the magnetic flux density of the developing pole is increased and the half-value width is reduced to not more than ½ of that in the conventional developing pole. However, according to the conventional ferrite-based magnet, decrease in the half-value width lowers the magnetic flux density. Thus, both of (1) and (2) cannot be unfavorably satisfied. The SLIC developing apparatus used herein is intended to moan that the developing apparatus includes a developer carrier made up of a nonmagnetic sleeve and a magnet roller fixed in place within said nonmagnetic sleeve and having a magnet for scooping up a developer, a magnetic pole for conveying said developer and a main magnetic pole for causing said developer to rise in a form of a head, a flux density in a direction normal to said main magnetic pole has an attenuation ratio of 40% or above. See U.S. Pat. No. 6,385,423 B1.

The specifications of the developing agent-carrying bodies used in the SLIC developing apparatuses depend upon kinds of the apparatuses, diameters of the rollers, etc. In recent apparatuses, the magnetic flux density is required to have 100~130 mT for a developing pole and an adjacent pole thereto, and high magnetization is largely demanded. The range of 100 to 130 mT in terms of the magnetic flux density on the developing agent-carrying body is converted to a range of 13 to 16 MGOe in terms of (BH) max value. Therefore, it is demanded that the magnetic flux density is not less than 13 MGOe, that is, a high magnetism magnet which exhibits not less than 100 mT when measured at a gap of 1 mm from a surface of a magnet in which a magnet body is attached to a non-magnetic body is sought.

Sm.Co based, Nd.Fe.B based and Sm.Fe.N based rare earth magnetic materials are well known as magnetic materials having high energy products for the magnetic bodies. However, since the Sm.Co based rare earth magnetic material has high material cost, it has been hardly used in general. Recently, Nd.Fe.B based magnetic material and the Sm.Fe.N based magnetic material have been frequently used. In order to obtain magnets having arbitrary shapes, a synthetic resin composition containing such a magnetic powder needs to be kneaded and molded in a desired arbitrary shape.

Conventionally, plastic magnets having arbitrary shapes have been used by molding the mixed material in which the magnetic material is kneaded with a plastic resin material. Such plastic magnets are produced by either one of the following methods: (1) injection molding (JP-2002-190421-A2), (2) extrusion molding (JP 2001-93724-A2), and (3) compression-molding (JP2001-118718-A2).

According to the above injection molding method (1), the mixed composition is melted under heating to have sufficient flowability, and a predetermined shape is given by injecting the heat-melted material into a mold. According to the above extrusion molding method (2), the mixed composition is melted under heating, and a predetermined shape is given by extruding the heat-melted material from a mold and solidifying it under cooling. According to the above compression-molding method (3), the mixed composition is charged into a mold where it is compression molded.

In the above injection molding method (1), since the dimension of the molded product is determined by the dimension of the mold, a magnet having a strange shape can be molded at a highly dimensional precision. However, a compounding ratio of the binder resin needs to be increased to smoothly flow the mixed composition into the mold, so that the compounding ratio of the magnet material must be decreased. Thus, it is unfavorably difficult to obtain magnets having high magnetism.

In the above extrusion molding method (2), since the mixed composition is continuously molded, productivity is high. To the contrary, it is unfavorably difficult to realize highly dimensional precision as compared with the injection molding method. Further, it is also difficult to increase the compounding ratio of the magnet material like the injection molding method. Consequently, it is also difficult to obtain magnets having high magnetism.

In the above compression-molding method (3), since the compounding ratio of the binder resin can be decreased, the density of the magnetic powder can be increased. Thus, this molding method is suitable for molding small-size magnets having high magnetism. However, in the compression-molding method (3), the pressing pressure needs to be increased to mold a large-size magnet having high magnetism so that the density of the molded product may be increased. At present, when the ordinary epoxy compound as the compression-molding compound is used, not less than 100 $kN/cm^2$ is required for the pressing pressure. Consequently, a 1000 $kN/cm^2$ class pressing machine is required to produce a molded elongate magnet product having a specific pole in magnet roller. Therefore, the construction of the compression-molding apparatus becomes large. Further, since the mechanical strength of the mold needs to be increased, it is unfavorably difficult to produce elongate magnets by compression-molding in a commercial level.

Some magnetic materials are isotropic, and other are anisotropic. Higher magnetism can be realized for magnetic materials having anisotropic property in which a magnetizing axis can be more easily aligned by applying a magnetic field thereto. An Nd.Fe.B based magnetic material treated with hydrogen at high temperature and having high anisotropy is proposed as the same kind of the currently practically used rare earth magnetic material having high magnetism (JP 10-135017-A2 and JP 8-31677-A2). Molded rare earth-based magnetic powders, which are produced by injection molding or extrusion molding with use of a magnet compound material containing Nd.Fe.B based magnetic powder, are commercially available as the molded rare earth-based magnetic bodies. The magnetism of such molded products is 6 to 9 MGOe in terms of (BH) max value, which is not sufficient.

In order to produce magnets having high magnetism of not less than 13 MGOe, the present inventors investigated use of the anisotropic Nd.Fe.B based magnetic material now having the highest magnetism, but they found out that the magnetism of the anisotropic Nd.Fe.B based magnetic material was 10 to 12 MGOe at most in terms of the (BH) max value at present when it was produced by the injection molding or the extrusion molding.

In general, the epoxy based thermosetting resin is used as the binder resin in the compound to be compression-molding. The epoxy resin and a curing agent are compounded in a entire amount of 1 to 10 wt % into the magnet material, and a dry compound is obtained in which the epoxy resin/curing agent is attached around the magnet material. However, in order to use the epoxy resin in the compound in a dry state, it is necessary to use solid epoxy resin and solid curing agent. Many materials such as aromatic amine-based, dicyandiamide-based and imidazole-based materials are available as the solid curing agent. Since any of these materials has a high curing temperature, the curing temperature needs to be at least 150° C. and the curing time is long and needs to be not less than 60 minutes.

The magnetic materials have such a property that their magnetisms is reduced with heat. Particularly since the anisotropic Nd magnet material is likely to decrease its magnetism with heat. Therefore, the magnetic characteristic (BH) max is unfavorably decreased by about 15% in the beat treatment of 150° C. and 60 minutes. Therefore, the thermosetting epoxy resin cannot be practically used as the binder resin. Even if a resin composition composed mainly of a thermoplastic resin is used as the binder resin, its magnetism cannot be prevented from being decreased with heat. Under the circumstances, when a kneaded compound composed mainly of a thermoplastic resin obtained by grinding and classifying and having a low softening point is used as the binder resin to suppress decrease in magnetism with heat, binder resin particles obtained by grinding and classifying have unstable particle shapes and distribution, so that sufficient molded density and magnetic flux density cannot be obtained. For this reason, there is a limit that the magnetic flux density of around 70 mT can be obtained on the average among lots. In addition, variations in the magnetic flux density are as much as around 20 mT among the lots of the binder resin particles.

When a kneaded material composed mainly of a thermoplastic resin having spherical particle shapes with a low softening point is used as the binder resin, mold-filling property is increased to raise the molded density and thereby enhance the magnetic flux density. The magnetic flux density of the thus molded magnet is around 95 mT, and variations in the magnetic flux density are as much as around 12 mT among the lots of the binder resin particles. Variations owing to the lots of the binder resin particles can be adjusted by varying magnetizing voltage. However, it takes a long time to adjust the magnetism, and if the magnetizing voltage is lowered, the magnetic flux density at opposite end portions of the magnet is unlikely to be decreased. Thus, since deviations in the magnetic flux density become larger in the axial direction of the magnet, there is a problem that the magnet having a uniform magnetic flux density cannot be obtained.

Since a compound is filled inside a mold cavity having a constant volume according to compression-molding method in a magnetic filed, the filled density differs depending upon the particle diameter distribution of the binder resin particles. FIG. 12 is a schematic view of the conventional magnet compound material to be used in the compression-molding method. When the magnetic powder 201 of the magnet compound material is mixed with the binder resin 202, the magnetic powder 201 and the binder resin particles 202 are charged plus and minus, respectively through friction electrification, and the binder resin particles 202 are electrostatically attached to around the magnetic powder 201. However, since the electrostatically attaching force of the binder resin particles 202 is relatively small, the binder resin particles are likely to be detached from the magnetic powder. Accordingly, as shown in FIG. 12, there appear binder resin-rich layers and magnetic powder-rich layers, so that variations in magnetic flux density (magnetic force) become greater in the magnet molded from the magnet compound material. Further, since the particle diameter distribution differs among the lots of the binder resin particles, variations in the magnetic flux density (magnetism) increase. In this way, when there are formed the binder resin particle-rich layers and the magnetic powder rich-layers or the particle diameter distribution of the binder resin particles 202 differs depending upon the lots, the filled density inside the mold varies. Thus, the molded density and the magnetic force vary among the magnets. However, when the magnet is used as a magnet in a developing agent-carrying body, an elongate magnet of around 300 mm in length is necessary, so that variations in magnetism of the magnetic pole need to be suppressed to within ±3 mT.

SUMMARY OF THE INVENTION

It is an object of the present invention to solve the above-mentioned problems.

That is, a first object of the present invention is to provide a magnet compound material to be compression molded, which can produce a compression molded magnet having high strength and high magnetism and reduced variations in magnetism inside the molded magnet and among the binder resin particles even when the compounds are molded in an elongate shape.

It is a second object of the present invention to provide a molded elongate magnet at a low cost by compression-molding the above magnet compound material.

It s a third object of the present invention to provide, at low costs, a high-performance magnet roller in which magnetism of a specific pole is increased by burying the above molded elongate magnet, a developing agent-carrying body having this magnet roller, a developing apparatus having the developing agent-carrying body, a processing cartridge having the developing apparatus, and an image-forming apparatus having the processing cartridge.

The magnet compound material to be compression molded according to a first aspect of the present invention comprises a magnet powder and a binder resin particles, wherein a ratio of Dv to Dn is in a range of 1.1 to 1.3, Dv and Dn of the binder resin particles denote the volume average particle diameter and the number average particle diameter of the binder resin particles, respectively.

The following constituent features are preferred embodiments of the first aspect of the present invention. Any combinations of (1) to (4) are also preferred embodiments of the first aspect of the present invention, unless any contradiction occurs.

(1) The volume average particle diameter Dv of the binder resin particles is in a range of 3 to 7 μm and a ratio of fine binder resin particles having not more than 2 μm is not more than 10 vol. % in the entire binder resin particles.

(2) In the above (1), a compounding ratio of the binder resin particles in the total magnet compound material is in a range of 4~10 vol. %.

(3) The magnetic powder contained in the magnet compound material is a magnetic powder constituted by sharp corner-removed magnetic powder grains having their sharp corners substantially removed and the average grain diameter of 100 to 200 μm, and a bulk density of the magnet compound material to be compression molded is in a range of 3.2 to 3.9 g/cm$^3$.

(4) The binder resin particles are fine particles having spherical shapes produced by emulsion polymerization or suspension polymerization.

A second aspect of the present invention is to provide a molded elongate magnet obtained by compression-molding the magnet compound material in any one of the first aspect of the present invention and the above preferred embodiments (1) to (4) in a magnetic field.

A third aspect of the present invention is to provide a magnet roller comprising a cylindrical magnet roller body which comprises a plastic magnet composed of a high-molecular material and a magnetic powder dispersed in said high-molecular compound, and at least one separate member, said magnet roller body having at least one channel-like receiving portion at a portion corresponding to a given magnetic pole of the magnet roller, said at least one separate member being buried in said at least one channel-like receiving portion, and said at least one separate member being at least one of said molded elongate magnets in the second aspect of the present invention and having magnetism larger than that of the plastic magnet.

A fourth aspect of the present invention is to provide a developing agent-carrying body comprising the magnet roller according to the third aspect of the present invention and a rotatable non-magnetic cylindrical body arranged around an outer periphery of said magnet roller.

A fifth aspect of the present invention is to provide a developing apparatus comprising a developing agent-carrying body, a developing agent-feeding member and a developing agent layer-restraining member, wherein said developing agent-carrying body is the developing agent-carrying body according to fourth aspect of the present invention.

A sixth aspect of the present invention is to provide a processing cartridge comprising a developing apparatus which comprises a developing agent-carrying body, a developing agent-feeding member and a developing agent layer-restraining member, an image-carrying body and a charging roller, wherein said developing apparatus is the developing apparatus according to the fifth aspect of the present invention.

A seventh aspect of the present invention is to provide an image-forming apparatus comprising a processing cartridge, an optically writing device, a transfer member and a fixing device, wherein said processing cartridge is the processing cartridge according to the sixth aspect of the present invention.

According to the first aspect of the present invention, the ratio of Dv to Dn is in the range of 1.1 to than 1.3, Dv and Dn of the binder resin particles denoting the volume average particle diameter and the number average particle diameter, respectively. Therefore, the magnet compound material to be compression molded can be provided to have the improved powder-filling property in the mold, so that even when the magnet compound material is compression molded into a magnet in an elongate form, the molded magnet has high strength and high magnetism, and variations in magnetism is reduced inside the molded magnet and among lots of the binder resin.

In the following, effects obtained by the above preferred embodiments (1) to (4) of the first aspect of the present invention will be discussed.

According to the preferred embodiment (1) of the first aspect of the present invention, the volume average particle diameter Dv of the binder resin particles is in a range of 3 to 7 μm and a ratio of the fine binder resin particles having not more than 2 μm is not more than 10 vol. % in the entire binder resin particles. Therefore, the magnet compound material to be compression molded can be provided to have the improved powder-filling property in the mold, so that even when the magnet compound material is compression molded into a magnet in an elongate form, the molded magnet has higher strength and higher magnetism, and variations in magnetism is more greatly reduced inside the molded magnet and among lots of the binder resin.

According to the second preferred embodiment (2) of the first aspect of the present invention, the compounding ratio of the binder resin particles in the entire magnet compound material is in a range of 4~10 vol. %. Therefore, the magnet compound material to be compression molded can be provided to have the more improved powder-filled property in the mold and improved orientation of the magnetic powder, so that the molded density and the magnetic property are thus further enhanced, and variations in the magnetism is further reduced inside the molded magnet and among lots of the binder resin.

According to the third preferred embodiment (3) of the present invention, the magnetic powder contained in the magnet compound material is the magnetic powder constituted by sharp corner-removed magnetic powder grains having the average grain diameter of 100 to 200 μm, and the bulk density of the magnet compound material is in a range of 3.2 to 3.9 g/cm$^3$. Therefore, the magnet compound material to be compression molded can be provided to have the more improved powder-filling property of the magnet compound material in the mold, the orientation of the magnetic powder, so that the molded magnet has the more increased molded density and the more increased magnetic property, and variations in the magnetism is further reduced inside the molded magnet and among lots of the binder resin.

According to the fourth embodiment of the first aspect of the present invention, the binder resin particles are fine particles having spherical shapes produced by emulsion polymerization or suspension polymerization. The density of the compression molded product can be increased, so that the magnetic property can be enhanced. Further, since the binder resin particles have fine spherical shapes, the covering area for the magnetic powder increases, so that an exposed area of the magnetic powder onto the surface of the molded magnet can be reduced to provide anti-rusting image.

According to the second aspect of the present invention, since the molded elongate magnet is obtained by compression-molding the magnet compound material in any one of the first aspect of the present invention and the above preferred embodiments (1) to (4) in a magnetic field, the molded elongate magnet having a reduced concentration of the binder resin and a large magnetic property can be obtained. Consequently, the molded elongate magnet having high magnetism of not less than 13 MGOe (not less than 100 mT) can be obtained.

According to the third aspect of the present invention, the magnet roller comprises the cylindrical magnet roller body constituted by the plastic magnet containing the magnetic powder, and at least one separate member, said magnet roller body having at least one channel-like receiving portion at the portion corresponding to a part of poles of the magnet roller, said separate member being buried in said channel-like receiving portion, respectively, and said at least one separate member being said molded elongate magnet according to the second aspect of the present invention and having magnetism larger than that of the plastic magnet. Therefore, high-performance magnet rollers can be obtained in which variations in magnetism can be further decreased, and the magnetism of the specific pole can be increased.

According to the fourth aspect of the present invention, since the developing agent-carrying body comprises the magnet roller according to the third aspect of the present invention and the rotatable non-magnetic cylindrical body arranged around the outer periphery of said magnet roller. The developing agent-carrying body has excellent developing agent-transferring force, and can prevent attachment of the developing agent on the carrier. So, the developing agent-carrying body enabling high quality images can be provided.

According to the fifth aspect of the present invention, in the developing apparatus at least comprising the developing agent-carrying body, the developing agent feeding member and the developing agent layer-restraining member, said developing agent-carrying body is the developing agent-carrying body according to fourth aspect of the present invention. Thus, the developing apparatus enabling the high quality image can be provided.

According to the sixth aspect of the present invention, in the processing cartridge at least comprising the developing apparatus which comprises the developing agent-carrying body, the developing agent-feeding member and the developing agent layer-restraining member, the image-carrying body and the charging roller, said developing apparatus is the developing apparatus according to the fifth aspect of the present invention. Thus, the processing cartridge enabling the high quality image can be provided.

According to the seventh aspect of the present invention, in the image-forming apparatus at least comprising the processing cartridge, the optically writing device, a transfer member and a fixing device, wherein said processing cartridge is the processing cartridge according to the sixth aspect of the present invention. Thus, the image-forming apparatus enabling the high quality image can be provided.

These and other objects, features and advantages of the invention will be appreciated when taken in conjunction with the attached drawings, with the understanding that some modifications, variations and changes of the same will be easily made by the skilled person in the art without departing from the scope and the spirit of the claimed invention.

The entire contents of Japanese patent application No. 2005-224558 filed on Aug. 2, 2005 of which the convention priority are claimed in this application, are incorporated hereinto by way of reference.

BRIEF DESCRIPTION OF THE DRAWINGS

For a better understanding of the invention, reference is made to the attached drawings, wherein.

DETAILED DESCRIPTION OF THE PREFERRED EMBODIMENTS

Figure 1:
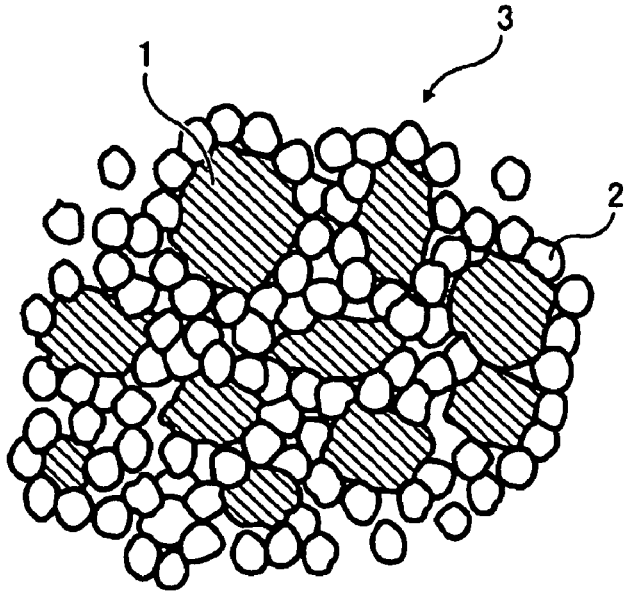
FIG. 1 is a schematic figure of a magnet compound material to be compression molded according to a first embodiment of the present invention.

As shown in FIG. 1, the magnet compound material 3 to be compression molded according to present invention comprises grains 1 of a magnetic powder and binder resin particles 2. The ratio of Dv/Dn is in a range of 1.1 to not 1.3 in which Dv are Dn are the volume average particle diameter and the number average resin particle diameter of the binder resin particles 2, respectively.

Figure 2:
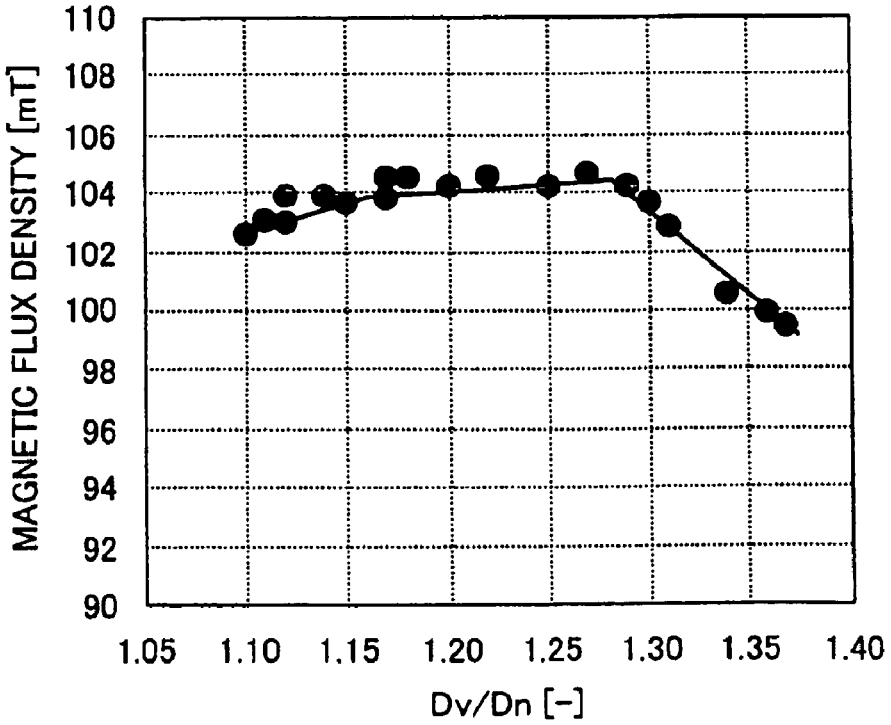
FIG. 2 is a graph showing the relationship between Dv/Dn and magnetic flux density in which Dv and Dn are the volume average particle diameter and the number average particle diameter, respectively.

There are the volume average particle diameter (hereinafter referred to as "Dv") and the number average particle diameter (hereinafter referred to as "Dn") which are indexes of distributing shapes in the particle diameter distribution of the binder resin particles. The Dv/Dn value corresponds to a distributing width of the particle diameter distribution. As shown in FIG. 2, if the Dv/Dn exceeds 1.3, the distribution width increases (flattened). Thus, the content of the intermediate particles decreases, whereas the content of the fine particles and that of the coarse particles increase. Accordingly, since the number of particles having extremely large particle diameters increases, the filling property is improved, but the magnet compound material is too closely filled. Accordingly, the orientation decreases, and the magnetic flux density drops. If the Dv/Dn value is less than 1.1, the distribution width becomes extremely narrower (shape). Thus, the amount of the fine particles of the binder resin that buries spaces between the binder resin particles decreases, so that the binding force decreases to cause the molded magnet to be bent or cut.

Therefore, if the ratio of the volume average particle diameter/the number average particle diameter of the binder resin particles 2 is in the range of 1.1 to 1.3 as in the present invention, the powder-filling property of the compression-molding magnet compound material inside the compression mold is improved, so that even when the magnet compound material is molded into the magnet in an elongate form, the magnet compound material 3 to be compression molded can be provided, which produces the magnet having high strength and high magnetism and having small variations in magnetism within the magnet and among the lots of the binder resins.

The magnetic powder 1 according to the present invention is constituted by a rare earth-based magnetic material which may afford high magnetization (not less than 13 MGOe). The rare earth magnetic body used in the present invention preferably comprises any one of (1) to (3). Among them, (1) is particularly preferred.

(1) R.Fe.B based alloys in which R is at least one element among rare earth elements, Fe is a main element as a transition metal, and B is a fundamental compound. Typically recited are Nd.Fe.B based alloys, Pr.Fe.B based alloys and Nd.Pr.Fe.B based alloy, Ce.Nd.Fe.B based alloy, Ce.Pr.Nd-.Fe.B based alloy, and so forth. There may be recited modified ones in which a part of Fe are replaced with another transition element such as Co and/or Ni.

(2) So called Sm.Co based alloys in which fundamental components Sm and Co are main elements as rare earth element and transition metal, respectively. Typically recited are $SmCo_5$ and $Sm_2TM_{17}$ (TM: transition metal).

3) So called Sm.Fe.N based alloys in which fundamental components Sm, Fe and N are main elements as rare earth element, transition metal, and interstitial element, respectively. Typically recited is $Sm_2Fe_{17}N_3$ produced by nitriding the $Sm_2TM_{17}$ alloy.

As the rare earth elements may be recited Y, La, Ce, Pr, Nd, Pm, Sm, Eu, Gd, Tb, Dy, Ho, Er, Tm, Yb, Lu, mesh metal. One or more kinds of them may be contained. As the transition metals may be recited Fe, Co, Ni, etc. One or more kinds of them may be contained. As magnetic powders improving the magnetic property may be contained B, Al, Mo, Cu, Ga, Si, Ti, Ta, Zr, Hf, Ag, Zn, etc. may be contained, depending upon necessity.

The compounding ratio of the magnetic powder 1 in the magnet compound material 3 to be compression molded is preferably 90 to 99 wt %. If the content of the magnetic powder 1 is less than 90 wt %, the magnetic property cannot be so enhanced as desired. On the other hand, if the content of the magnetic powder 1 is more than 99 wt %, the relative content of the binder resin particles 2 becomes relatively fewer, so that moldability may be lowered as desired. Consequently, the resulting magnet may be cracked in worst cases.

For example, the thermoplastic resin material constituting the above binder resin particles 2 may be produced by dispersing and mixing a charge controlling agent (CCA), a colorant, and a low softening point material (wax) into a resin material such as polyester or polyol, and adding a surface additive such as silica or titanium oxide around the powder grains to increase flowing property. The above binder resin particles 2 are preferably produced by polymerization such as emulsion polymerization or suspension polymerization, and are in the form of spherical particles. The binder resin particles 2 are likely to be charged negatively, and have excellent flowability, so that the binder resin particles exhibit excellent electrostatic adhesion upon the magnetic powder. Thus, the resin particles can well bury gaps among the magnet powder. Since the average particle diameter of the binder resin particles 2 preferably falls in a range of 3 to 7 μm when produced by polymerization such as the emulsion polymerization or the suspension polymerization.

As the surface additive, mention may be made of metal oxides such as aluminum oxide, titanium oxide, cerium oxide, magnesium oxide, chromium oxide, tin oxide, zinc oxide and the like, nitrides such as silicon nitride and the like, carbides such as silicon carbide and the like, metal salts such as calcium sulfate such as calcium sulfate, barium sulfate, strontium titanate, calcium carbonate and the like, metal salts of fatty acids such as zinc stearate, calcium stearate and the like, carbon black, silica, etc. Particle diameters of the externally adding agents are ordinarily in a range of 0.1 to 1.5 μm, and the addition amount thereof is 0.01 to 10 parts by weight, and preferably 0.05 to 5 parts by weight when the total weight before the addition of the externally adding agent is taken as 100 parts by weight. Each of these external additives may be used alone, or any plural additives may be used in combination. The additives are preferably made hydrophobic.

As the colorant, mention may be made of carbon black, lampblack, magnetite, titanium black, chromium yellow, ultramarine blue, aniline blue, phthalocyanine blue, phthalocyanine green, hansa yellow G, rhodamine 6G, calco oil blue, quinacridone, benzyl yellow, rose bengal, malachite green lake, quinoline yellow, C.I. pigment-red 48:1, C.I. pigment-red 122, C. I. pigment-red 57:1, C. I. pigment-red 184, C.I. pigment-yellow 12, C.I. pigment-yellow-12, C.I. pigment-yellow 17, C.I. pigment-yellow 97, C. I. pigment-yellow -17, C. I. pigment-yellow 97, C. I. pigment-yellow 180, C. I. solvent-yellow 162, C. I. pigment-blue-5:1, C.I. pigment-blue-15:3, carmine, etc.

A low-softening point material may be added as an internal additive. As the low-softening point material, mention may be made of paraffin wax, polyolefin wax, Fischer-Tropsch wax, amido wax, higher fatty acid, ester wax, their derivatives, graft/block compounds thereof and the like. Such a low-softening point material is preferably added in an amount of 5 to 30% by weight.

In the present invention, the volume average particle diameter of the binder resin particles 2 is preferably 3 to 7 μm, and the content of fine particles of not more than 2 μm is preferably not more than 10% for the total binder resin particles.

Figure 3:
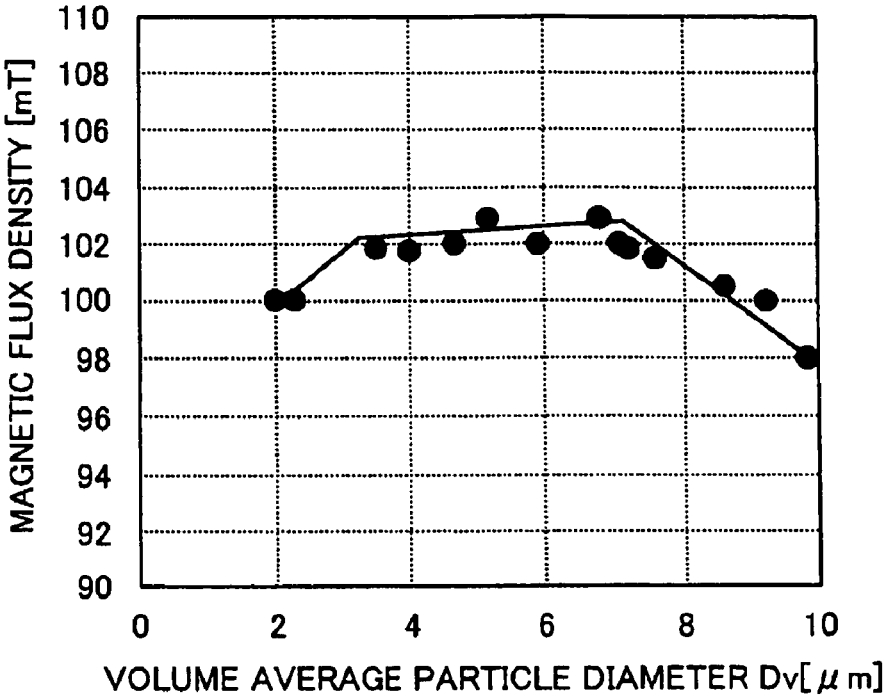
FIG. 3 is a graph showing the relationship between the volume average particle diameter and the magnetic flux density.

If the volume average particle diameter is less than 3 μm, the content of the fine particles of not more than 2 μm increases, so that the filling property inside the mold decreases to lower the magnetic flux density as shown in FIG. 3 and make it difficult to perform favorable molding owing to formation of non-filled portions. If the volume average particle diameter is more than 7 μm, the filling property within the mold is improved, but there is no sufficient amount of the fine particles to bury gaps among the magnetic powder grains. Thus, the density of the molded product decreases, and accordingly the magnetic flux density drops. If the content of fine particles of not more than 2 μm is more than 10% for the binder resin particles, the filling property within the mold decreases, and variations in magnetism in the axial direction tend to increase, so that non-filled portions may be formed in which favorable molding is difficult.

Therefore, when the volume average particle diameter of the binder resin particles 2 is preferably 3 to 7 μm, and the content of fine particles of not more than 2 μm is preferably not more than 10% for the total binder resin particles, the powder-filling property of the magnet compound material 3 within the mold on the compression-molding increases, so that it is possible to provide the magnet compound material 3 for the compression-molding, which can produce the compression molded magnet having higher strength and higher magnetism and more largely reduced variations within the molded magnets and the lots of the binder resin, when the magnet compound material is molded into the elongate magnet.

Figure 4:
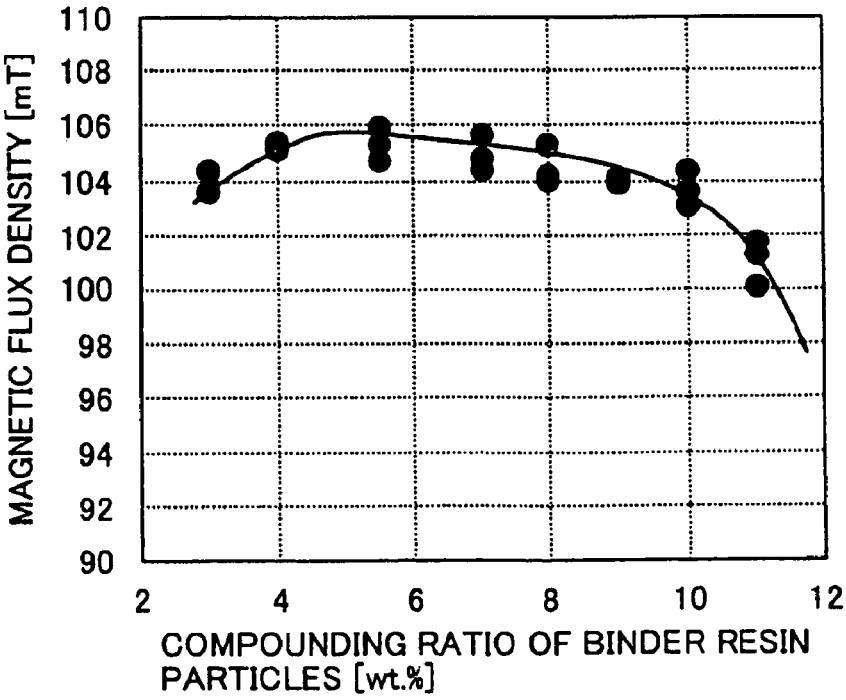
FIG. 4 is a graph showing a relationship between the compounding ratio of the binder resin particles and the magnetic flux density.

In the present invention, the compounding ratio of the binder resin particles 2 is preferably 4 to 10 vol. %. If the compounding ratio of the binder resin particles is over 10 vol. %, the ratio of the magnetic powder 1 decreases, and the content of the fine powder in the magnet compound material 3 to be compression molded. The filling property within the mold of the magnet compound material 3 decreases, so that the magnetism of the molded magnet rapidly lowers as shown in FIG. 4. Therefore, when the compounding ratio of the binder resin particles is 4 to 10 vol. %, the powder-filling property of the magnet compound material 3 within the mold is further enhanced, and the orientation of the magnetic powder 1 is improved. Accordingly, it is possible to provide the magnet compound material 3 to be compression molded, which produces the compression molded magnet having the molded density and the magnetic properties further improved, while variations in magnetism are further decreased within the molded magnet and lots of the binder resin.

Figure 5:
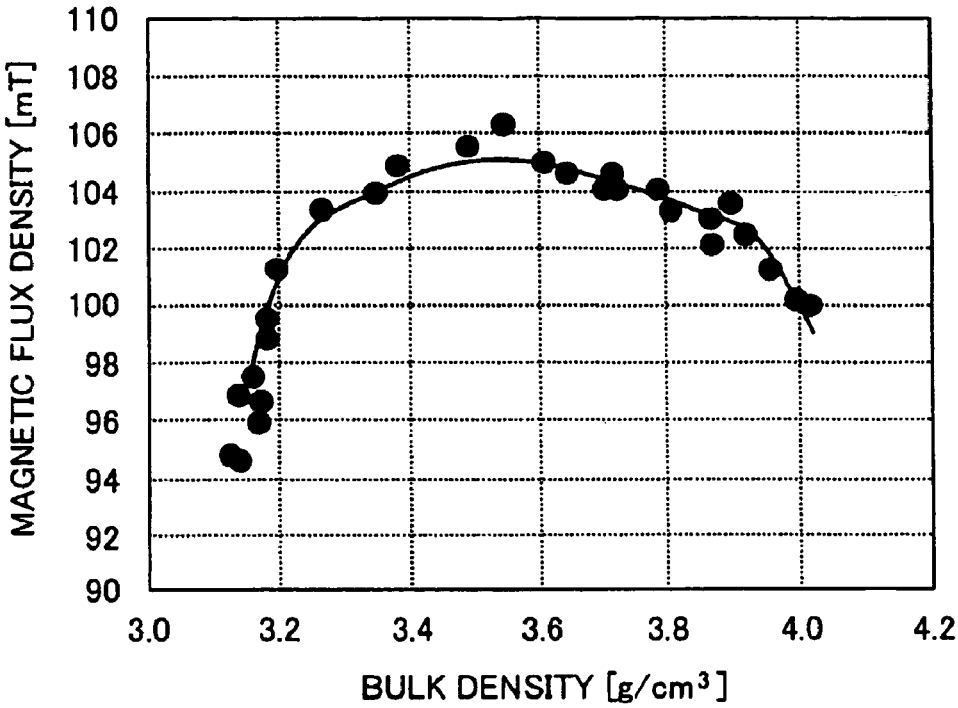
FIG. 5 is a graph showing the relationship between the bulk density and the magnetic flux density of the magnet compound material to be compression molded.

Preferably in the present invention, the magnetic powder grains 1 contained in the magnet compound material 3 to be compression molded are constituted by magnetic powder having sharp corners substantially removed and the average grain size of 100 to 200 μm, and the bulk density of the magnet compound material is 3.2 to 3.9 g/cm$^3$. As shown in FIG. 5, if the bulk density is less than 3.2 g/cm$^3$, the filling property of the magnet compound material 3 within the mold cavity decreases and thus non-filled portions may tend to be formed, so that it may become difficult to perform favorable molding. If the bulk density is more than 3.9 g/cm$^3$, the filling property is improved, but the compound may tend to be tightly filled so that the orientation property and the magnetic flux density may be decreased. Therefore, when the magnetic powder 1 contained in the magnet compound material 3 to be compression molded is constituted by the sharp corner-removed magnetic powder 1 having the average particle diameter of 100 to 200 μm, and the bulk density of the magnet compound material 3 is 3.2 to 3.9 g/cm$^3$, the powder-filling property of the magnet compound material 3 within the mold is further enhanced, and the orientation property of the magnetic powder 1 is improved. Accordingly, it is possible to provide the magnet compound material 3 to be compression molded, which produces the compression molded magnet having the molded density and the magnetic properties further improved, while variations in magnetism are further decreased within the molded magnet and among lots of the binder resin.

In the present invention, the binder resin particles 2 are preferably fine spherical particles produced by emulsification polymerization or the suspension polymerization. When the binder resin particles 2 are fine spherical particles produced by emulsification polymerization or the suspension polymerization, the density of the compression molded product can be increased. Thus, the magnetic property can be improved. If the binder resin particles are spherical particles, their covering area for the magnetic powder increases, the exposed area of the magnetic powder 1 to the surface of the molded magnet is decreased. This offers an anti-rusting effect.

Figure 6A:
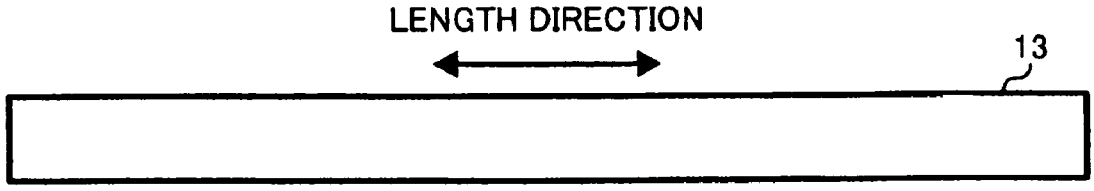
FIGS. 6(A) and 6(B) are a front view and an elevation view of illustrating an elongate magnet according to one embodiment of the present invention, respectively.
Figure 6B:
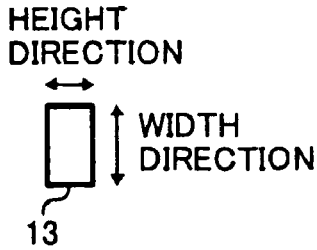
Figure 7:
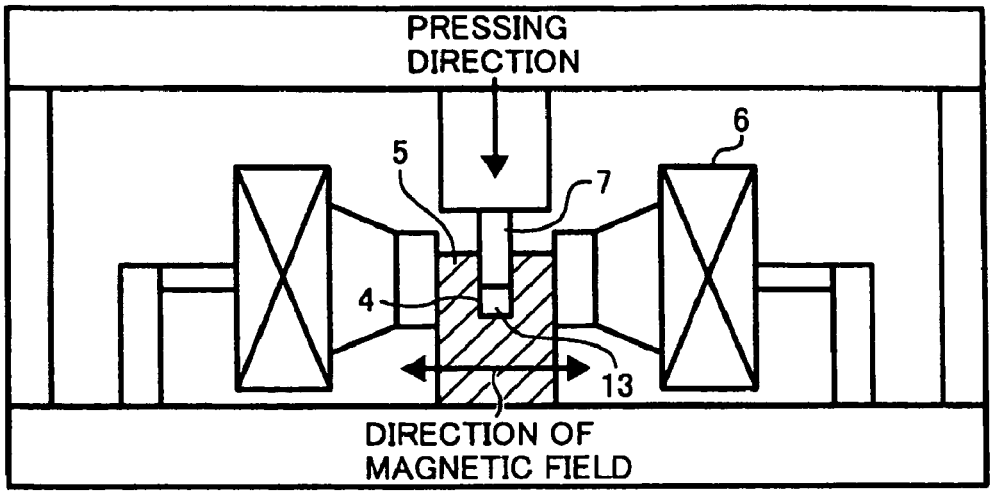
FIG. 7 is a schematically side view illustrating a compression-molding apparatus.

In the present invention, the magnet compound material 3 according to the present invention is compression molded to a molded elongated magnet 13 in a magnetic field as shown in FIGS. 6(A), 6(B) and 7. More specifically, the magnet compound material (See "3" in FIG. 1) containing the binder resin particles (See "2" in FIG. 1) is filled in a cavity 4 inside the lower mold unit 5. The magnet compound material is then compression molded to a molded elongate magnet 13 by pressing with an upper mold 7 in a pressing direction within a magnetic field in directions as shown in arrows. In FIG. 7, a reference numeral 6 denotes a coil. In this way, the magnet compound material 3 is compression molded into the molded elongate magnet 13 in the magnetic field, it is possible to produce the elongate magnet having the content of the in the magnetic field, the molded elongate magnet 3 can have the reduced concentration of the binder resin particles 2 and the increased magnetic properties. Thus, the molded elongate magnet 13 having high magnetism of not less than 13 MGOe (100 mT) can be obtained.

Figure 8A:
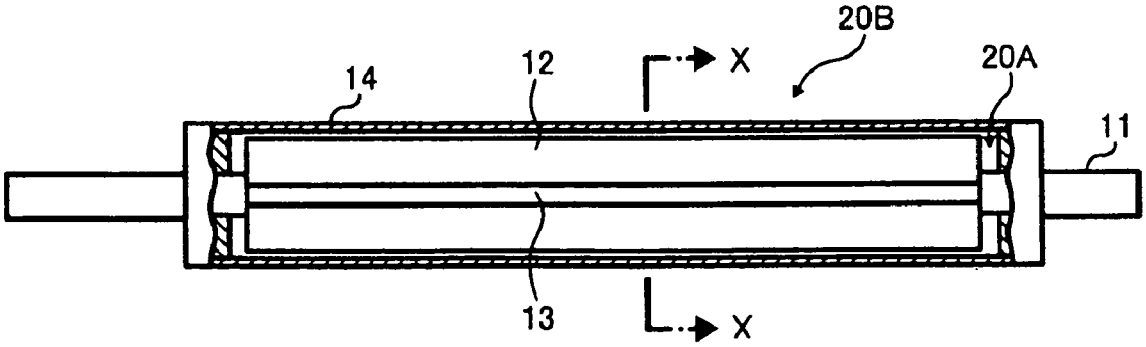
FIG. 8(A) is a partially sectional, schematic view of a developing agent-carrying body (developing roller) showing a further embodiment of the present invention, and FIG. 8(B) an X-X sectional view illustrating the image-forming apparatus.
Figure 8B:
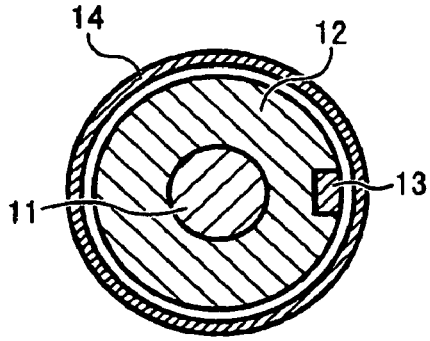

As shown in FIGS. 8(A) and 8(B), a magnet roller 20A according to the present invention comprises a cylindrical molded magnet roller body 12 and a separate member 13. The magnet roller body 12 is constituted by a plastic magnet composed of a high-molecular material and a magnetic powder dispersed in the high-molecular material, and is provided with one channel-like receiving portion at a portion corresponding to a part of poles of the magnet roller. The separate member 13 is buried in the channel-like receiving portion. The molded elongate magnet according to the present invention having magnetism larger than that of the plastic magnet is used as the separate member. In FIGS. 8(A) and 8(B), a single separate member 13 and a single corresponding channel-like receiving portion 11 are employed, but it goes without saying that plural separate members 13 and plural corresponding channel-like receiving portions 11 may be employed in the present invention. In the present invention, "bury" means that the outer surface of the separate magnet member 13 may be substantially in flush with the surrounding outer peripheral surface of the cylindrically molded magnet roller body 12 or may be radially outwardly projected from the surrounding outer peripheral surface of the cylindrically molded magnet roller body 12, so long as the separate magnet member does not hinder rotation of a non-magnetic rotary sleeve around the separate magnet member. In this way, the molded elongate magnet according to the present invention having magnetism higher than that of the plastic magnet of the cylindrically molded magnet 12 is buried in the receiving channel-like portion, the high-performance magnet roller 20A with the magnetism of only the specific pole being enhanced can be obtained.

The above magnet roller comprises a core shaft and a roller portion formed around the core shaft as molded by extruding the plastic magnet compound material in which the magnetic powder is distributed in the polymer compound and which is provided, at a portion corresponding to a part of poles of the magnet roller, with at least one channel-like depression portion into which a separate member may be insertable, and at least one molded elongate magnet 13 is arranged in at least one depression. In this way, when the molded elongate magnet 13 is arranged in the depression, the magnet flux distribution can be obtained uniformly in the axial direction, so that the magnet roller having high design margin can be obtained.

As shown in FIGS. 8(A) and 8(B), the developing agent carrier body 20B according to the present invention comprises the above magnet roller 20A and a non-magnetic cylindrical body 14 rotatably arranged around the magnet roller. As the non-magnetic cylindrical body 14, mention may be made of aluminum, SUS (stainless steel) or the like may be used. In addition, aluminum is suitably used for the cylindrical-magnetic body 14, because aluminum has good workability and has light weight. As aluminum, mention may be made of A6063, A5056, A303 and the like. As the SUS, 303, 304 and 316 and the like may be used. In this way, when the rotatable non-magnet cylindrical body 14 is arranged around the outer periphery of the magnet roller according to the present invention, the developing agent-carrying body 20B can be obtained, which has excellent developing agent-transferring force, can prevent the attachment of the developing agent upon the carrier, and thereby enables the high quality image formation.

Figure 9:
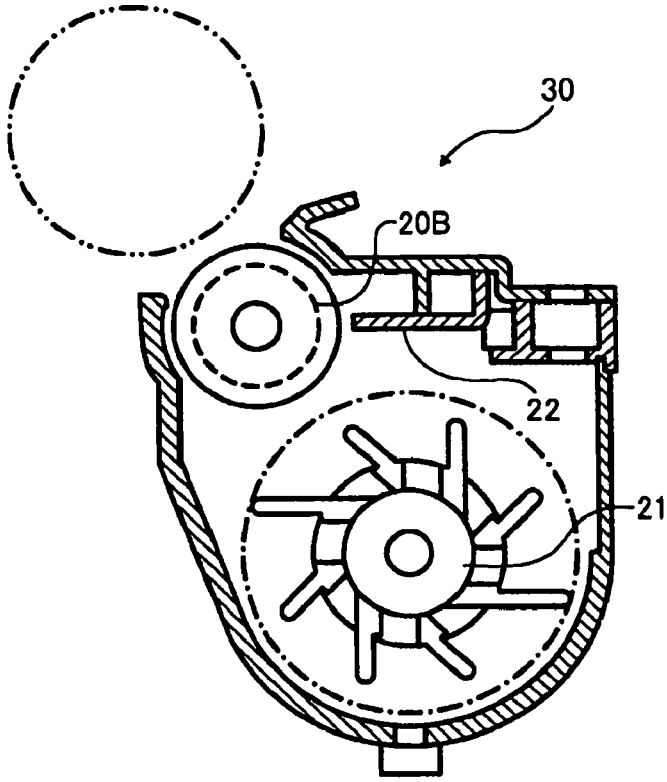
FIG. 9 is a schematic view of a developing apparatus according to a further embodiment of the present invention.

As shown in FIG. 9, the developing apparatus 30 comprises at least a developing agent-carrying body 20B, a developing agent feeding member 21 and a developing agent-restraining member 22. The developing apparatus 30 possesses the above developing agent-carrying body 20B according to the present invention as its developing agent-carrier body 20B. When the above developing agent-carrying body 20B of the present invention is employed, it is possible to provide the developing apparatus 30 capable of giving high quality images.

Figure 10:
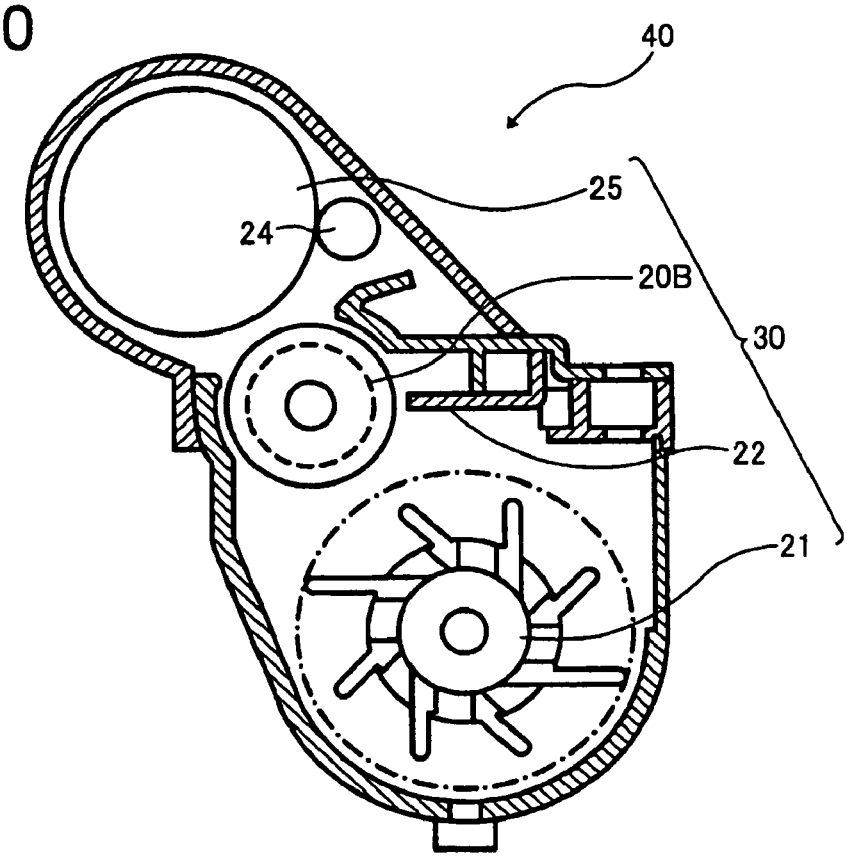
FIG. 10 is a schematic view of a processing cartridge according to a further embodiment of the present invention.

As shown in FIG. 10, the processing cartridge 40 comprises a developing apparatus 30, a charging roller 24 and an image-carrying body 25, said developing apparatus 30 comprising at least a developing agent-carrying body 20B, a developing agent-feeding member 21 and a developing agent layer-retraining member 22. The processing cartridge 40 possesses the above developing apparatus 30 according to the present invention as its developing apparatus 30. In this way, the processing cartridge 40 comprising this developing apparatus 30 according to the present invention can be provided to enable high quality image formation.

Figure 11:
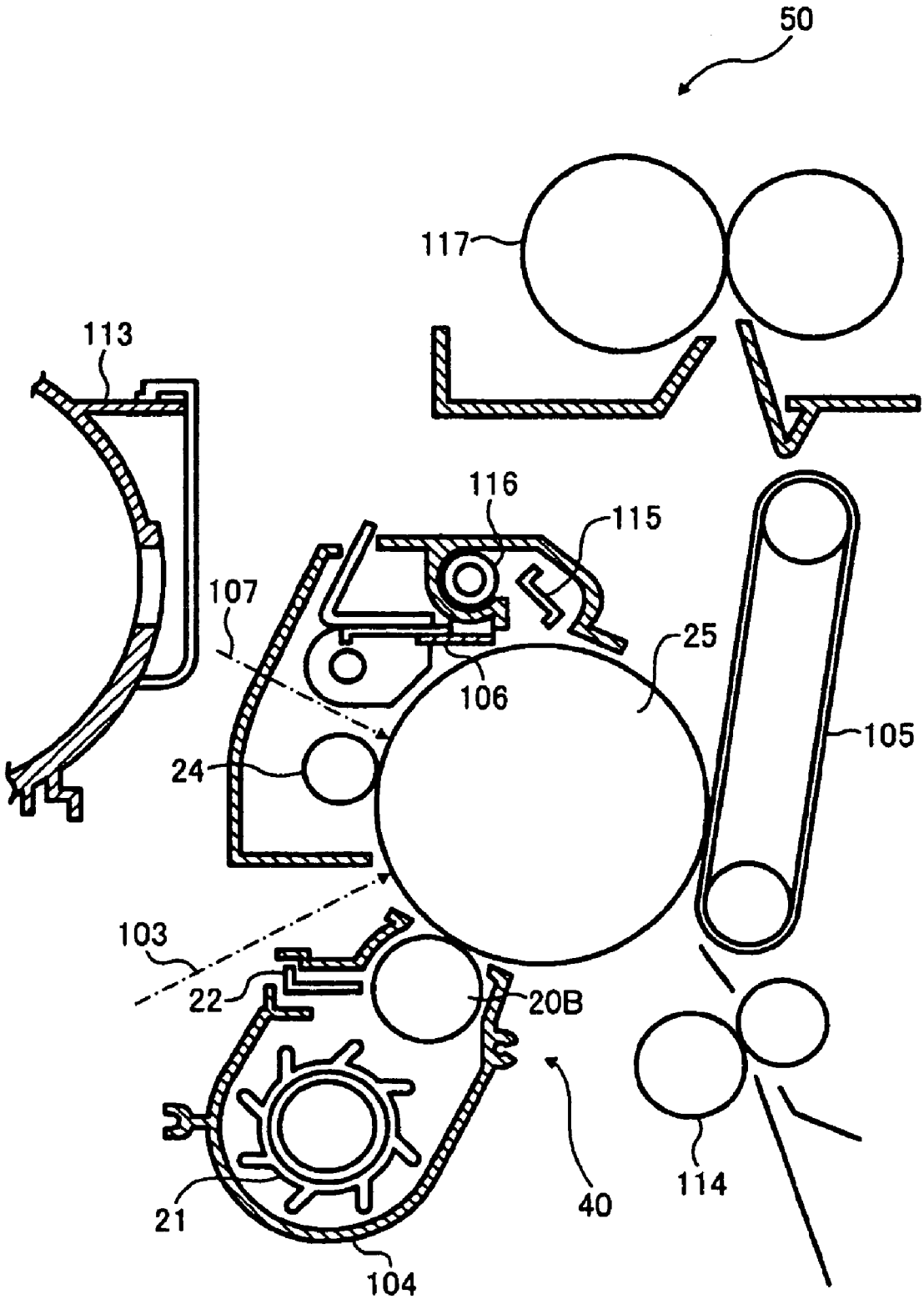
FIG. 11 is a schematic view of an image-forming apparatus according a still further embodiment of the present invention.
Figure 12:
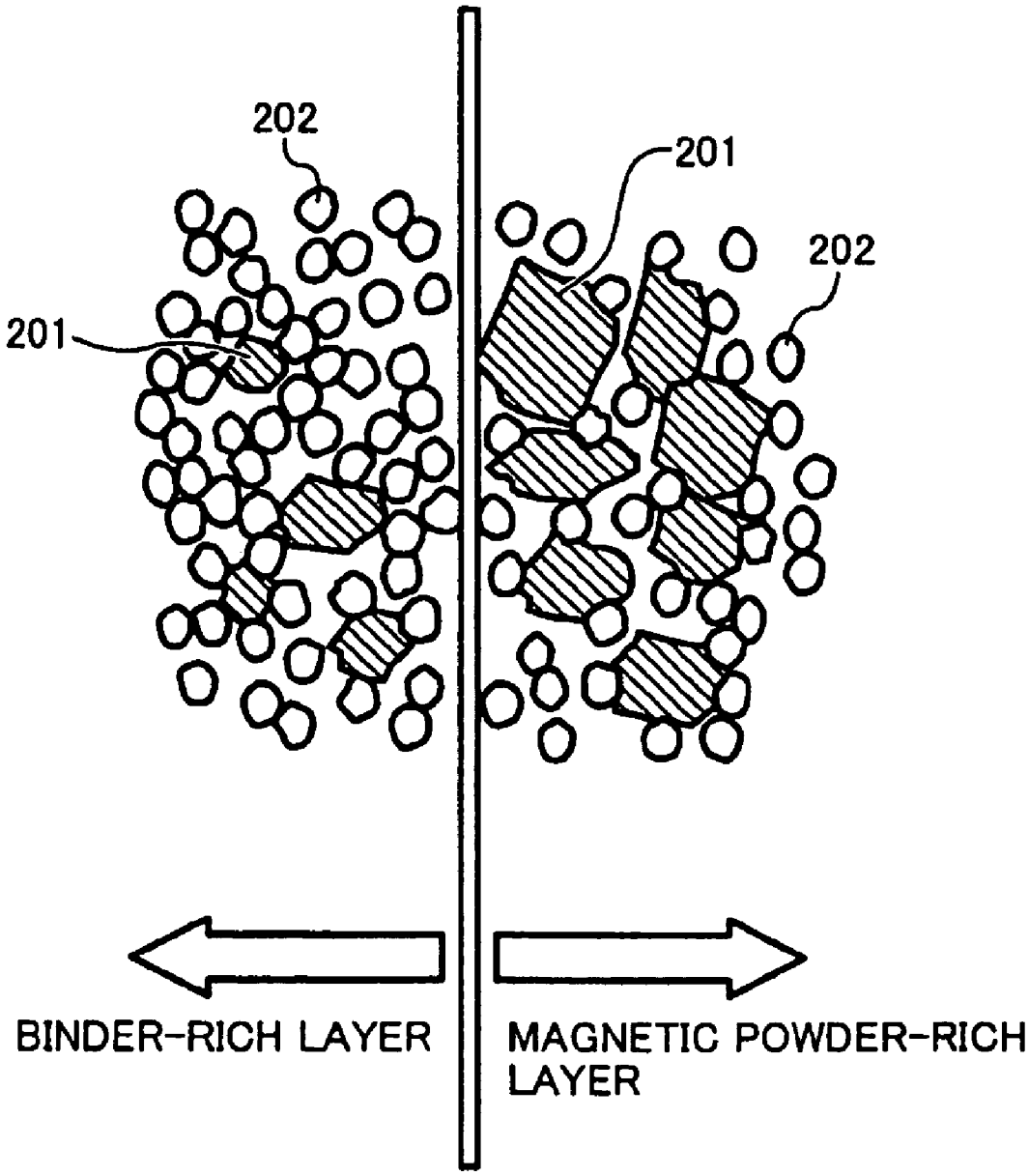
FIG. 12 is a schematic view of a magnet compound material to be compression-molding according to the conventional method.

As shown in FIG. 11, the image-forming apparatus 50 according to the present invention comprises at least a processing cartridge 40, an optically writing device 103, a transfer member 105 and a fixing device 117. The image-forming apparatus 50 according to the present invention possesses the above processing cartridge 40 as its processing cartridge. In this way, the image-forming apparatus 50 comprising the processing cartridge 40 according to the present invention can be provided to realize the high quality image formation.

In FIG. 11, the processing cartridge 40 according to the present invention comprises at least a developing apparatus 30, a charging roller 24 and an image-carrying body 25, said developing apparatus 30 comprising at least a developing agent-carrying body 20B, a developing agent-feeding member 21 and a developing agent-retraining member 22. In FIG. 11, 106 denotes a cleaning blade, 107 an electricity-removing optical system, 113 a toner supply section, 114 resist roller, 115 a toner-recovering blade, 117 a fixing device and 116 a toner transfer device.

EXAMPLE 1

(1) First, 945 g of anistropical Nd.Fe.B based magnet powder (MFP-12, manufactured by Aichi Seikou Co., Ltd.) having the average particle diameter of 102 μm was prepared. Next, this magnet powder was mixed with 55 g of a binder resin particles composed of a thermoplastic resin consisting of 79 wt. % of a polyester resin and 7 wt. % of a styrene acrylic resin and having a softening point of 75° C., 7.6 wt. % of carbon black, 0.9 wt. % of zirconium salicylate (antistatic agent), 4.3 wt. % of a mixture (mold-releasing agent) composed of carnauba wax and rice wax, and 1.2 wt. % of hydrophobic silica (flowability-imparting agent), and the resulting mixture was stirred and dispersed for 10 minutes with a tubular mixer, thereby obtaining a compound to be compression molded. The above binder resin particles had (a) Dv/Dn=1.11, (b) Dv=5.1, (c) the content of fine particles of not more than 2 μm being 6.7%, (d) compounding ratio of the binder being 5.5 vol. % and (e) bulk density of 3.6. The above figures in (a), (b) and (c) were calculated through measurement of the particle size distribution of the binder resin particles by using a particle size distribution measuring apparatus (Machine model: Sysmex manufactured by Mastersizer2000 manufacturer) The figure in (e) was determined through filling and heaping 485 g of magnet compound material for compression-molding in a 100-cc metallic container via a funnel, striking a part of the heaped magnet compound material along an upper face of the container, and weighing the weight of the remaining compound.

(2) The above magnet compound material, 20.0 g, was filled in a mold made of a magnetic material (SKS material) and having a width of 2.5 mm, a height of 14.0 mm and a length of 311.0 mm, and molded under pressing pressure of 400 kN, while 100 A of an orientating current was flown in a direction orthogonal to the pressing direction. Next, the mold and the molded magnet were demagnetized together with pulses At 3500 V in the state that the molded magnet was placed in the mold. Thereafter, the mold was split to remove the molded magnet. Then, the molded magnet was fired at 100° C. for 60 minutes, and was magnetized with pulse waves under a magnetic field of 2.6 T generated. Thereby, a molded elongate magnet was obtained.

EXAMPLE 2

A molded elongate magnet was obtained in the same manner as in Example 1 except that a different lot of the binder resin particles was used in Example 2 instead of that in the above (1) of Example 1. The binder resin particles used in Example 2 had (a) Dv/Dn=1.11, (b) Dv=3.2 and (c) the content of fine particles of not more than 2 μm being 9.0%, (d) the compounding ratio of the binder=5.5 vol. %, and (e) the compressing molding compound had the bulk density of 3.4.

EXAMPLE 3

A molded elongate magnet was obtained in the same manner as in Example 1 except that a different lot of the binder resin particles was used in Example 3 instead of that in the above (1) of Example 1. The binder resin particles used in Example 3 had (a) Dv/Dn=1.3, (b) Dv=500.3, (c) the content of fine particles of not more than 2 μm being 7.0%, (d) compounding ratio of the binder being 5.5 vol. %, and (e) bulk density of 3.5.

EXAMPLE 4

A molded elongate magnet was obtained in the same manner as in Example 1 except that a different lot of the binder resin particles was used in Example 4 instead of that in the above (1) of Example 1 and that 20.5 g of the magnet compound material to be compression molded was filled in a mold in Example 4 to obtain the same dimension of the molded product instead of that in the above (2) in Example 1. The binder resin particles used in Example 4 had (a) Dv/Dn=1.11, (b) Dv=4.9, (c) the content of fine particles of not more than 2 μm being 6.9%, (d) compounding ratio of the binder being 4.0 vol. %, and (e) bulk density of 3.9.

EXAMPLE 5

A molded elongate magnet was obtained in the same manner as in Example 1 except that a different lot of the binder resin particles was used in Example 5 instead of that in the above (1) of Example 1 and that 18.4 g of the magnet compound material to be compression molded was filled in a mold in Example 5 to obtain the same dimension of the molded product instead of that in the above (2) in Example 1. The binder resin particles used in Example 5 had (a) Dv/Dn=1.11, (b) Dv=4.9, (c) the content of fine particles of not more than 2 μm being 6.9%, (d) compounding ratio of the binder being 10.0 vol. %, and (e) bulk density of 3.3.

COMPARATIVE EXAMPLE 1

A molded elongate magnet was obtained in the same manner as in Example 1 except that a different lot of the binder resin particles was used in Comparative Example 1 instead of that in the above (1) of Example 1 and that 16.6 g of the magnet compound material to be compression molded was filled in a mold in Comparative Example 1 to obtain the same dimension of the molded product instead of that in the above (2) in Example 1. The binder resin particles used in Comparative Example 1 had (a) Dv/Dn=1.05, (b) Dv=2.8, (c) the content of fine particles of not more than 2 μm being 15.0%, (d) compounding ratio of the binder being 15.0 vol. %, and (e) bulk density of 2.8.

COMPARATIVE EXAMPLE 2

A molded elongate magnet was obtained in the same manner as in Example 1 except that a different lot of the binder resin particles was used in Comparative Example 2 instead of that in the above (1) of Example 1 and that 21.2 g of the magnet compound material to be compression molded was filled in a mold in Comparative Example 2 to obtain the same dimension of the molded product instead of that in the above (2) in Example 1. The binder resin particles used in Comparative Example 2 had (a) Dv/Dn=1.5, (b) Dv 10, (c) the content of fine particles of not more than 2 μm being 2.0%, (d) compounding ratio of the binder being 2.0 vol. %, and (e) bulk density of 4.2.

With respect to the molded elongate magnets obtained in Examples 1 to 5 and Comparative Examples 1 and 2, the width dimension (mm), the height dimension (mm), the magnetic flux density (mT) (average values, deviations) and the number of magnets with acceptable appearance (number of molded elongate magnets free from breakage and fracture) were measured. The width (mm) and the height (mm) were measured with a micrometer (See FIG. 6). The magnetic flux density (mT) was measured in such a manner that the molded elongate magnet was magnetized with pulse voltage 2200 V, and the magnetic flux density distribution in the length direction of the molded elongate magnet was measured by using a magnetically measuring probe and a magnetic measurement machine at a gap of 1 mm from the average height of the molded elongate magnets. In Table 1, "OK" means that the magnet is suitable for practical use without problem, whereas "NG" means that the magnet is unacceptable for practical use. Resulting measurement results and target values are as shown in Table 1.

TABLE 1

| | Width (mm) | Height (mm) | Magnetic Flux Density Average value mT | Magnetic Flux Density Deviation mT | Appearance "OK" magnets |
|---|---|---|---|---|---|
| Target Value | 6.0 ± 0.1 | 2.5 ± 0.03 | ≧100 | ≦6 | Criterion* |
| Example 1 | 5.98~6.03 | 2.49~2.51 | 110 | 3.5 | 10/10 |
| Example 2 | 5.96~6.05 | 2.48~2.52 | 108 | 4.1 | 10/10 |
| Example 3 | 5.97~6.04 | 2.48~2.52 | 109 | 3.7 | 10/10 |
| Example 4 | 5.98~6.01 | 2.49~2.51 | 107 | 3.2 | 10/10 |
| Example 5 | 5.95~6.01 | 2.48~2.52 | 106 | 4.2 | 10/10 |
| Comp. Ex. 1 | 5.84~6.16 | 2.42~2.55 | 86 | 7.1 | 3/10** |
| Comp. Ex. 2 | 5.95~6.08 | 2.47~2.52 | 96 | 4.5 | 4/10*** |

Note:
*Number of magnets free from breakage or fracture
Total number of magnets tested
**Seven magnets (NG) broken
***Six magnets (NG) fractured The following are seen from Table 1. That is, the molded elongate magnets obtained in Examples 1 to 5 are stable in terms of the dimensions and the magnetic flux density. In addition, the molded elongate magnets obtained in Examples 1 to 5 have high magnetism and deviations of around 5 mT among lots thereof (Deviations in the conventional molded elongate magnets are around 1.2 mT among lots). To the contrary, with respect to the molded elongate magnet obtained in Comparative Example 1, there were a greater amount of fine powders and a large amount of the binder particles in the magnet compound material to be compression molded. Thus, the magnet compound material had poor filling property in the mold, so that its magnetism was low and variations in the longitudinal direction were larger. Therefore, it was difficult to obtain a molded elongate magnet to be practically used. Further, there were much coarse powders in the magnet compound material to be compression molded into the magnet obtained in case of Comparative Example 2. Thus, the magnet compound material had good filling property in the mold and reduced strength due to poor bondability. In addition, the magnet compound material was too closely filled and molded, so that the orientation of the molded elongate magnet and the magnetism were decreased. Further, the variations in the molded elongate magnets obtained in Comparative Examples 1 and 2 were 10 mT.

The present patent application claims priority under 35 U.S.C. §119 upon Japanese Patent Application No. 2005-224558, filed in the Japan Patent Office on Aug. 2, 2005, the disclosure of which is incorporated by reference herein in its entirety.

What is claimed is:

1. A magnet compound material to be compression molded, said magnet compound material comprising a rare earth based magnetic powder and thermoplastic binder resin particles, wherein a ratio of Dv to Dn is in a range of about 1.1 to about 1.3, Dv and Dn of the binder resin particles denoting the volume average particle diameter and the number average particle diameter of the binder resin particles, respectively.

2. The magnet compound material set forth in claim 1, wherein the volume average particle diameter Dv of the binder resin particles is in a range of about 3 to about 7 μm and a ratio of fine binder resin particles having not more than about 2 μm is not more than about 10 vol. % in the entirety of binder resin particles.

3. The magnet compound material set forth in claim 1, wherein a compounding ratio of the binder resin particles in the entire magnet compound material is in a range of about 4~about 10 vol. %.

4. The magnet compound material set forth in claim 1, wherein the magnetic powder contained in the magnet compound material is a magnetic powder constituted by magnetic powder grains having sharp corners substantially removed and the average grain diameter of about 100 to about 200 μm, and a bulk density of the magnet compound material to be compression molded is in a range of about 3.2 to about 3.9 $g/cm^3$.

5. The magnet compound material set forth in claim 3, wherein the magnetic powder contained in the magnet compound material is a magnetic powder constituted by magnetic powder grains having sharp corners substantially removed and the average grain diameter of about 100 to about 200 μm, and a bulk density of the magnet compound material to be compression molded is in a range of about 2.2 to about 3.9 $g/cm^3$.

6. The magnet compound material set forth in claim 1, wherein the binder resin particles are fine particles having spherical shapes produced by emulsion polymerization or suspension polymerization.

7. The magnet compound material set forth in claim 3, wherein the binder resin particles are fine particles having spherical shapes produced by emulsion polymerization or suspension polymerization.

8. The magnet compound material set forth in claim 4, wherein the binder resin particles are fine particles having spherical shapes produced by emulsion polymerization or suspension polymerization.

9. The magnet compound material set forth in claim 5, wherein the binder resin particles are fine particles having spherical shapes produced by emulsion polymerization or suspension polymerization.

* * * * *